US006044578A

United States Patent [19]

Kelz

[11] Patent Number: 6,044,578

[45] Date of Patent: Apr. 4, 2000

[54] SKI BOOT WALKING ATTACHMENT

[76] Inventor: William K. Kelz, 3207 Forest Oaks Dr., Sun Prairie, Wis. 53590

[21] Appl. No.: 09/224,308

[22] Filed: Dec. 31, 1998

[51] Int. Cl.[7] ..... A43B 3/10; A43B 5/04

[52] U.S. Cl. ..... 36/7.5; 36/117.4; 36/7.6

[58] Field of Search ..... 36/117.4, 7.5, 36/7.6, 135, 117.3

[56] References Cited

U.S. PATENT DOCUMENTS

| | | | |
|---|---|---|---|
| 1,811,781 | 6/1931 | Degge | 36/7.5 |
| 4,123,854 | 11/1978 | Pasich | 36/7.5 |
| 4,299,037 | 11/1981 | Carey | 36/7.6 |
| 4,872,273 | 10/1989 | Smeed | 36/7.5 |
| 4,958,445 | 9/1990 | Brisco | 36/117.4 |

*Primary Examiner*—M. D. Patterson

[57] ABSTRACT

A ski boot walking attachment for attachment to an Alpine ski boot for aiding a wearer in walking. The attachment includes a sole having top and bottom faces, front and back ends, and a pair of sides extending between the front and back ends of the sole. The sole also has front, middle and back portions. The width of the middle portion is less than the widths of the front and back portions. The front portion has a front wall upwardly extending from the top face of sole along the front outer perimeter while the back portion has a back wall upwardly extending from the top face of sole along the back outer perimeter. In use, the top face of the sole is adapted for resting the bottom of a ski boot thereon such that the toe of the ski boot abuts against the front wall and the heel of the ski boot abuts against the back wall so that the ski boot is held between the front and back walls.

1 Claim, 2 Drawing Sheets

SKI BOOT WALKING ATTACHMENT

BACKGROUND OF THE INVENTION

1. Field of the Invention

The present invention relates to devices for facilitating the walking in ski boots and more particularly pertains to a new ski boot walking attachment for attachment to an Alpine ski boot for aiding a wearer in walking.

1. Description of the Prior Art

The use of devices for facilitating the walking in ski boots is known in the prior art. More specifically, devices for facilitating the walking in ski boots heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,286,397; U.S. Pat. No. 3,665,620; U.S. Pat. No. 4,291,473; U.S. Pat. No. Des. 340,123; U.S. Pat. No. 2,849,237; and U.S. Pat. No. 3,283,424.

While these devices fulfill their respective, particular objectives and requirements, the aforementioned patents do not disclose a new ski boot walking attachment. The inventive device includes a sole having top and bottom faces, front and back ends, and a pair of sides extending between the front and back ends of the sole. The sole also has front, middle and back portions. The width of the middle portion is less than the widths of the front and back portions. The front portion has a front wall upwardly extending from the top face of sole along the front outer perimeter while the back portion has a back wall upwardly extending from the top face of sole along the back outer perimeter. In use, the top face of the sole is adapted for resting the bottom of a ski boot thereon such that the toe of the ski boot abuts against the front wall and the heel of the ski boot abuts against the back wall so that the ski boot is held between the front and back walls.

In these respects, the ski boot walking attachment according to the present invention substantially departs from the conventional concepts and designs of the prior art, and in so doing provides an apparatus primarily developed for the purpose of attachment to an Alpine ski boot for aiding a wearer in walking.

SUMMARY OF THE INVENTION

In view of the foregoing disadvantages inherent in the known types of devices for facilitating the walking in ski boots now present in the prior art, the present invention provides a new ski boot walking attachment construction wherein the same can be utilized for attachment to an Alpine ski boot for aiding a wearer in walking.

The general purpose of the present invention, which will be described subsequently in greater detail, is to provide a new ski boot walking attachment apparatus and method which has many of the advantages of the devices for facilitating the walking in ski boots mentioned heretofore and many novel features that result in a new ski boot walking attachment which is not anticipated, rendered obvious, suggested, or even implied by any of the prior art devices for facilitating the walking in ski boots, either alone or in any combination thereof.

To attain this, the present invention generally comprises a sole having top and bottom faces, front and back ends, and a pair of sides extending between the front and back ends of the sole. The sole also has front, middle and back portions. The width of the middle portion is less than the widths of the front and back portions. The front portion has a front wall upwardly extending from the top face of sole along the front outer perimeter while the back portion has a back wall upwardly extending from the top face of sole along the back outer perimeter. In use, the top face of the sole is adapted for resting the bottom of a ski boot thereon such that the toe of the ski boot abuts against the front wall and the heel of the ski boot abuts against the back wall so that the ski boot is held between the front and back walls.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new ski boot walking attachment apparatus and method which has many of the advantages of the devices for facilitating the walking in ski boots mentioned heretofore and many novel features that result in a new ski boot walking attachment which is not anticipated, rendered obvious, suggested, or even implied by any of the prior art devices for facilitating the walking in ski boots, either alone or in any combination thereof.

It is another object of the present invention to provide a new ski boot walking attachment which may be easily and efficiently manufactured and marketed.

It is a further object of the present invention to provide a new ski boot walking attachment which is of a durable and reliable construction.

An even further object of the present invention is to provide a new ski boot walking attachment which is susceptible of a low cost of manufacture with regard to both materials and labor, and which accordingly is then susceptible of low prices of sale to the consuming public, thereby making such ski boot walking attachment economically available to the buying public.

Still yet another object of the present invention is to provide a new ski boot walking attachment which provides in the apparatuses and methods of the prior art some of the advantages thereof, while simultaneously overcoming some of the disadvantages normally associated therewith.

Still another object of the present invention is to provide a new ski boot walking attachment for attachment to an Alpine ski boot for aiding a wearer in walking.

Yet another object of the present invention is to provide a new ski boot walking attachment which includes a sole having top and bottom faces, front and back ends, and a pair of sides extending between the front and back ends of the sole. The sole also has front, middle and back portions. The width of the middle portion is less than the widths of the front and back portions. The front portion has a front wall upwardly extending from the top face of sole along the front outer perimeter while the back portion has a back wall upwardly extending from the top face of sole along the back outer perimeter. In use, the top face of the sole is adapted for resting the bottom of a ski boot thereon such that the toe of the ski boot abuts against the front wall and the heel of the ski boot abuts against the back wall so that the ski boot is held between the front and back walls.

Still yet another object of the present invention is to provide a new ski boot walking attachment that fits on the sole of a ski boot to protect the bottom of the ski boot from damage.

Even still another object of the present invention is to provide a new ski boot walking attachment that provides traction to a wearer of ski boots when walking.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
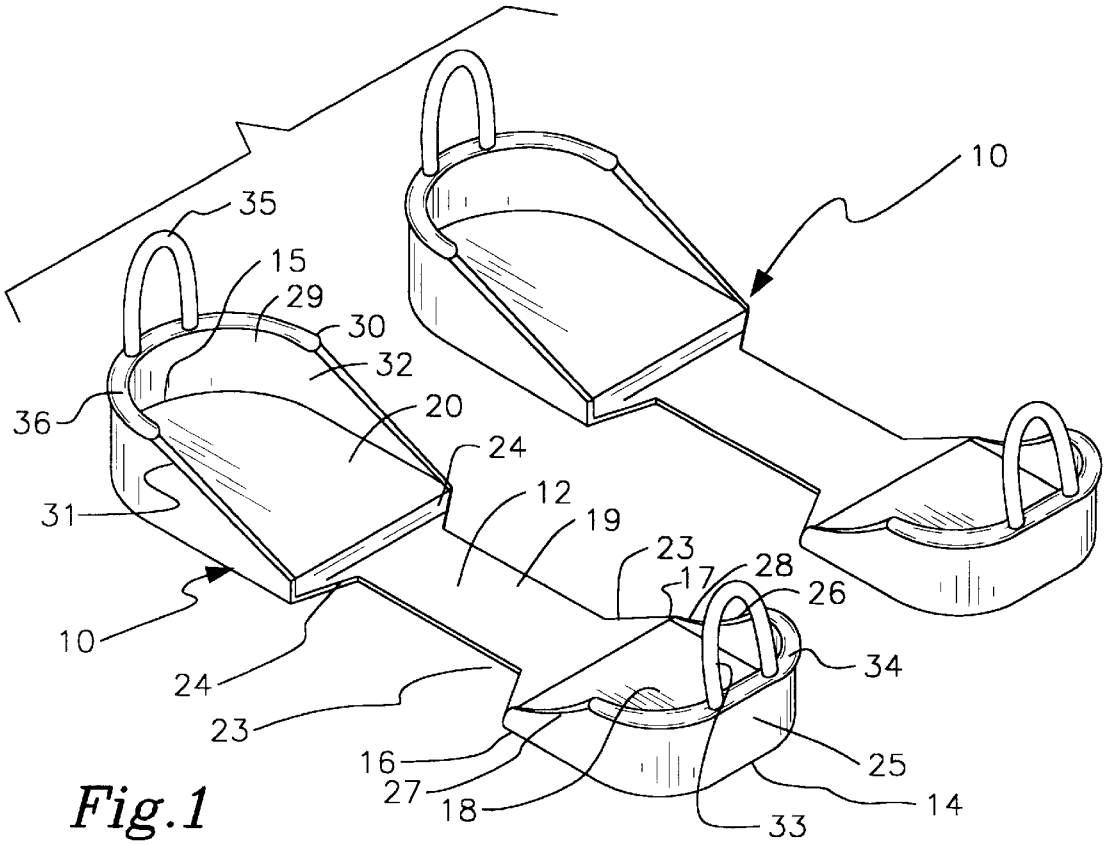
FIG. 1 is a schematic perspective view of a pair of a new ski boot walking attachments according to the present invention.
Figure 2:
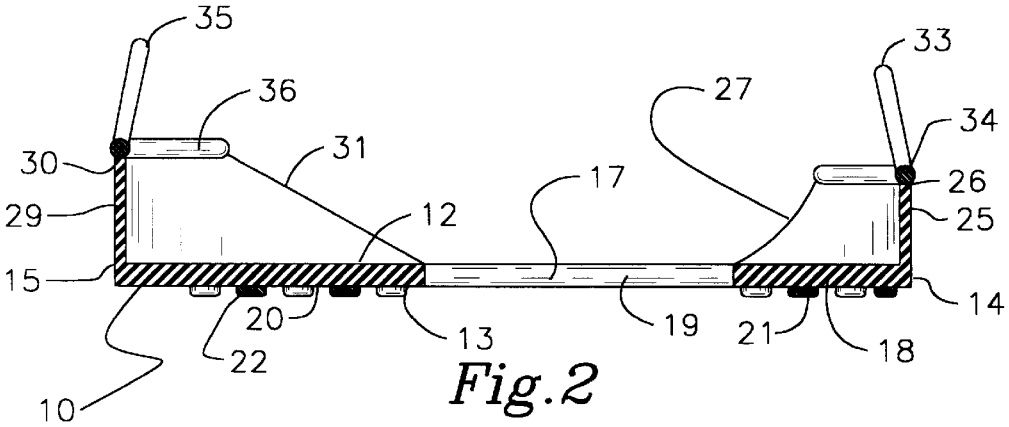
FIG. 2 is a schematic cross sectional view of the present invention taken from line 2—2 on FIG. 1.
Figure 3:
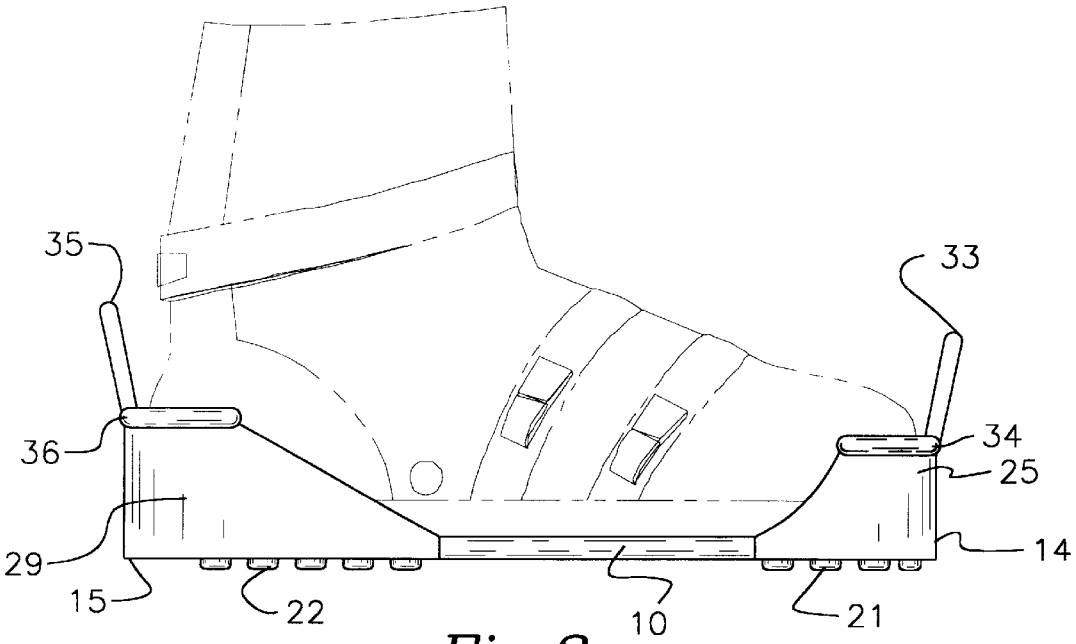
FIG. 3 is a schematic side view of the present invention in use on a ski boot.
Figure 4:
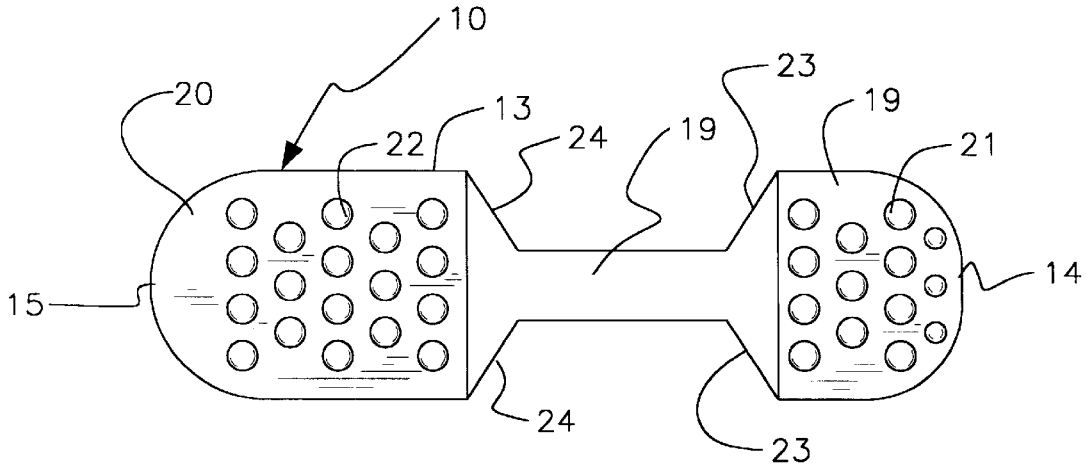
FIG. 4 is a schematic bottom side view of the present invention.

With reference now to the drawings, and in particular to FIGS. 1 through 4 thereof, a new ski boot walking attachment embodying the principles and concepts of the present invention will be described.

As best illustrated in FIGS. 1 through 4, the ski boot walking attachment generally comprises a sole 10 having top and bottom faces 12,13, front and back ends 14,15, and a pair of sides 16,17 extending between the front and back ends 14,15 of the sole 10. The sole 10 also has front, middle and back portions 18,19,20. The width of the middle portion 19 is less than the widths of the front and back portions 18,20. The front portion 18 has a front wall 25 upwardly extending from the top face 12 of sole 10 along the front outer perimeter while the back portion 20 has a back wall 29 upwardly extending from the top face 12 of sole 10 along the back outer perimeter. In use, the top face 12 of the sole 10 is adapted for resting the bottom of a ski boot 1 thereon such that the toe of the ski boot 1 abuts against the front wall 25 and the heel of the ski boot 1 abuts against the back wall 29 so that the ski boot 1 is held between the front and back walls 25,29.

In closer detail, the attachment has a sole 10 with generally planar top and bottom faces 12,13, front and back ends 14,15, and a pair of sides extending between the front and back ends 14,15 of the sole 10. The top face 12 of the sole 10 is designed for resting the bottom of a ski boot 1 thereon while the bottom face 13 of the sole 10 is designed for engaging a walking surface. The sole 10 also has front, middle and back portions 18,19,20. The front portion 18 is positioned adjacent the front end 14 of the sole 10, the back portion 20 is positioned adjacent the back end 15 of the sole 10, and the middle portion 19 is interposed between the front and back portions 18,20.

The front, middle and back portions 18,19,20 each have a length defined along a line extending between the front and back ends 14,15 of the sole 10. Preferably, the lengths of the front, middle and back portions 18,19,20 is generally equal to one another. The front, middle and back portions 18,19,20 each have a width defined between the corresponding side portions of the sides 16,17 of the sole 10. The widths of the front and back portions 18,20 are preferably generally equal to one another while the width of the middle portion 19 is less than the widths of the front and back portions 18,20. Preferably, the width of the middle portion 19 is between about one-fifth and about four-fifths the widths of the front and back portions 18,20. Ideally, the width of the middle portion 19 is about one-half the widths of the front and back portions 18,20.

The front, middle, and back portions 18,19,20 each have a corresponding side portion of each of the sides 16,17 of the sole 10. The corresponding side portions the front portion 18 are generally parallel to each other. The corresponding side portions of the middle portion 19 are generally parallel to each other. The corresponding side portions of the back portion 20 are generally parallel to each other. Each of the sides has a front converging region 23 between the corresponding side portions of the front and middle portions 18,19. The front converging regions 23 are extended at an obtuse angle to the corresponding side portions of the front and middle portions 18,19 such that the width of the sole 10 tapers from the front portion 18 to the middle portion 19. Similarly, each of the sides has a back converging region 24 between the corresponding side portions of the back and middle portion 20,19. The back converging regions 24 are extended at an obtuse angle to the corresponding side portions of the back and middle portion 20,19 such that the width of the sole 10 tapers from the front portion 18 to the middle portion 19.

The front end 14 and the corresponding side portions of the front portion 18 defining an front outer perimeter. Similarly, the back end 15 and the corresponding side portions of the back portion 20 defining a back outer perimeter. The front portion 18 has a front wall 25 upwardly extending from the top face 12 of sole 10 along the front outer perimeter. The front wall 25 has an upper edge 26. The front wall has a height defined from the top face of the sole 10 to the upper edge 26 of the front wall 25 adjacent the front end 14 of the sole 10. The front wall 25 has a sloped portion 27,28 adjacent each of the corresponding side portions of the front portion 18. The upper edge 26 of the front wall 25 along each of the sloped portions 27,28 of the front wall 25 slope towards the top face 12 of the sole 10 adjacent the middle portion 19 such that the upper edges of the sloped portions of the front wall 25 lie in planes extending at an obtuse angle to the top face 12 of the sole 10 so that the height of the sloped portions 27,28 reduces towards the middle portion 19.

The back portion 20 has a back wall 29 upwardly extending from the top face 12 of sole 10 along the back outer perimeter, the back wall 29 has an upper edge 30. The back wall 29 has a height defined from the top face 12 of the sole 10 to the upper edge 30 of the back wall 30 29 adjacent the back end 15 of the sole 10. The height of the back wall 29 is preferably greater than the height of the front wall 25 so that the back wall does not slip off of the heel of the ski boot between the front and back walls.

Like the front wall, the back wall 29 has a sloped portion 31,32 adjacent each of the corresponding side portions of the back portion 20. The upper edge 30 of the back wall 29 along each of the sloped portions 31,32 of the back wall 29 slope towards the top face 12 of the sole 10 adjacent the middle portion 19 such that the upper edges of the sloped portions 31,32 of the back wall 29 lie in planes extending at an obtuse angle to the top face 12 of the sole 10 so that the height of the sloped portions 31,32 reduces towards the middle portion 19.

An arcuate front pulling loop 33 is coupled to the upper edge 26 of the front wall 25 adjacent the front end 14 of the sole 10 such that the front pulling loop 33 upwardly extends from the upper edge 26 of the front wall 25. The front pulling loop 33 is designed for pulling the front wall 25 in a direction away from the back wall 29. Preferably, the upper edge 26 of the front wall 25 has a reinforced portion 34 extending therealong between the sloped portions 27,28 of the front wall 25 so that the front pulling loop 33 is not torn away from the front wall 25 when pulled. Similarly, an arcuate back pulling loop 35 is coupled to the upper edge 30 of the back wall 29 adjacent the back end 15 of the sole 10 such that the back pulling loop 35 upwardly extends from the upper edge 30 of the back wall 29. The back pulling loop 35 is designed for pulling the back wall 29 in a direction away from the front wall 25. Preferably, the upper edge 30 of the back wall 29 also has a reinforced portion 36 extending therealong between the sloped portions 31,32 of the back wall 29 so that the back pulling loop 35 is not torn away from the back wall 29 when pulled. Ideally, the front and back pulling loops 33,35 each extend a height of about 1½ inches from the upper edge 26,30 of their associated wall.

The sole 10 and the front and back walls 25,29 comprise a flexible resiliently elastic material, such as a flexible resiliently elastic rubber, so that the attachment fits around the bottom of the ski boot 1 to protect it and provide additional traction when walking with the ski boots 1.

Preferably, the bottom face 13 of the sole 10 has a plurality of generally circular protrusions 21,22 or cleats downwardly extending therefrom. A number 21 of the plurality of protrusions 21,22 are located on the front portion 18 while another number 22 of the plurality of protrusions are located on the back portion 20. In use, the protrusions 21,22 are designed for providing additional traction to the wearer on the walking surface.

In use, the top face 12 of the sole 10 is adapted for resting the bottom of a ski boot 1 thereon such that the toe of the ski boot 1 abuts against the front wall 25 and the heel of the ski boot 1 abuts against the back wall 29. The front and back walls 25,29 are adapted for holding the ski boot 1 therebetween to attach the attachment to the ski boot 1. Preferably, the distance between the front and back walls 25,29 is less than the length of the ski boot 1 between the heel and toe of the ski boot 1 such that the resilient properties of the front and back walls 25,29 hold the ski boot 1 between themselves and such that the front and back walls 25,29 must be pulled apart by pulling on the front and back pulling loops 33,35 to release the ski boot 1 from between the front and back walls 25,29. Preferably, to put the attachment on a ski boot, the toe of the ski boot 1 is abutted against the front wall 25 and the back wall 29 is pulled in a direction away from the front wall 25 by the back pulling strap so that the heel of the ski boot 1 can be rested on the top face 12 of the sole 10. Thus, when the back wall 29 is returned to its position, the heel of the ski boot 1 abuts the back wall 29 so that the ski boot 1 is held between the front and back walls 25,29.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An attachment for attaching to the bottom of a ski boot, said attachment comprising:

a sole having generally planar top and bottom faces, front and back ends, and a pair of sides extending between said front and back ends of said sole, said top face of said sole being adapted for resting the bottom of a ski boot thereon, said bottom face of said sole being adapted for engaging a walking surface;

said sole having front, middle and back portions, said front portion being positioned adjacent said front end of said sole, said back portion being positioned adjacent said back end of said sole, and said middle portion being interposed between said front and back portions;

said bottom face of said sole having a plurality of generally circular protrusions downwardly extending therefrom, a number of said plurality of protrusions being located on said front portion, another number of said plurality of protrusions being located on said back portion, said protrusions being adapted for providing additional traction to the wearer on the walking surface;

said front, middle and back portions each having a length defined along a line extending between said front and back ends of said sole, wherein said lengths of said front, middle and back portions being generally equal to one another;

said front, middle and back portions each having a width defined between the corresponding portions of said sides of said sole, said widths of said front and back portions being generally equal to one another, said width of said middle portion being less than said widths of said front and back portions;

wherein said width of said middle portion is about one-half said widths of said front and back portions;

said front, middle, and back portions each having a corresponding side portion of each of said sides of said sole;

said corresponding side portions said front portion being generally parallel to each other;

said corresponding side portions of said middle portion being generally parallel to each other;

said corresponding side portions of said back portion being generally parallel to each other;

each of said sides having a front converging region between said corresponding side portions of said front and middle portions, said front converging regions being extended at an obtuse angle to said corresponding side portions of said front and middle portions such that said width of said sole tapers from said front portion to said middle portion;

each of said sides having a back converging region between said corresponding side portions of said back and middle portions, said back converging regions being extended at an obtuse angle to said corresponding side portions of said back and middle portions such that said width of said sole tapers from said front portion to said middle portion;

said front end and said corresponding side portions of said front portion defining an front outer perimeter;

said front portion having a front wall upwardly extending from said top face of sole along said front outer perimeter, said front wall having an upper edge;

said front wall having a height defined from said top face of said sole to said upper edge of said front wall adjacent said front end of said sole, said front wall having a sloped portion adjacent each of said corresponding side portions of said front portion, said upper edge of said front wall along each of said sloped portions of said front wall sloping towards said top face of said sole adjacent said middle portion such that said upper edges of said sloped portions of said front wall lie in planes extending at an obtuse angle to said top face of said sole;

said back end and said corresponding side portions of said back portion defining a back outer perimeter;

said back portion leaving a back wall upwardly extending from said top face of sole along said back outer perimeter, said back wall having an upper edge;

said back wall having a height defined from said top face of said sole to said upper edge of said back wall adjacent said back end of said sole, said height of said back wall being greater than said height of said front wall;

said back wall having a sloped portion adjacent each of said corresponding side portions of said back portion, said upper edge of said back wall along each or said sloped portions of said back wall sloping towards said top face of said sole adjacent said middle portion such that said upper edges of said sloped portions of said back wall lie in planes extending at an obtuse angle to said top face of said sole;

an arcuate front pulling loop being coupled to said upper edge of said front wall adjacent said front end of said sole such that said front pulling loop upwardly extends from said upper edge of said front wall, said front pulling loop being for pulling the front wall in a direction away front the back wall;

said upper edge of said front wall having a reinforced portion extending therealong between said sloped portions of said front wall for preventing the front pulling loop from tearing away from the front wall when the front pulling loop is pulled;

a arcuate back pulling loop being coupled to said upper edge of said back wall adjacent said back end of said sole such that said back pulling loop upwardly extends from said upper edge of said back wall, said back pulling loop being for pulling the back wall in a direction away from the front wall;

said upper edge of said back wall having a reinforced portion extending therealong between said sloped portions of said back wall for preventing the back pulling loop for tearing away from the back wall when the back pulling loop is pulled;

said front and back pulling loops each extending a height of about 1½ inches from the upper edge of their associated wall;

said sole and said front and back walls comprising a flexible resiliently elastic material such that the attachment fits around the bottom of the ski boot to protect the ski boot and provide additional traction when walking in the ski boots, wherein said sole comprises a flexible resiliently elastic rubber to aid traction and to help hold the ski boot between the front and back walls; and wherein said top face of said sole is adapted for resting the bottom of a ski boot thereon such that the toe of the ski boot abuts against said front wall and the heel of the ski boot abuts against the back wall, said front and back walls being adapted for holding the ski boot therebetween to attach the attachment to tile ski boot.

* * * * *